US005875939A

United States Patent [19]

Geier

[11] Patent Number: 5,875,939

[45] Date of Patent: Mar. 2, 1999

[54] VALVE FOR THE DISCHARGE OF FLUIDS WHICH ARE UNDER PRESSURE

[75] Inventor: Adalberto Geier, Calceranica al Lago, Italy

[73] Assignee: Coster Tecnologie Speciali S.P.A., Italy

[21] Appl. No.: 825,355

[22] Filed: Mar. 28, 1997

[30] Foreign Application Priority Data

Mar. 29, 1996 [DE] Germany ..... 196 12 702.5

[51] Int. Cl.[6] ..... B65D 83/00

[52] U.S. Cl. ..... 222/341; 222/402.2

[58] Field of Search ..... 222/341, 402.1, 222/402.2, 518

[56] References Cited

U.S. PATENT DOCUMENTS

| | | | |
|---|---|---|---|
| Re. 33,552 | 3/1991 | Bougamont et al. | 222/402.2 |
| 3,394,851 | 7/1968 | Gorman | 222/402.2 |
| 3,608,830 | 9/1971 | Ramella | 222/402.2 |
| 3,901,410 | 8/1975 | Schultz | 222/153 |
| 5,397,059 | 3/1995 | Baudin | 222/402.2 |

FOREIGN PATENT DOCUMENTS

| | | |
|---|---|---|
| 388715 | 8/1989 | Austria . |
| 2121523 | 11/1971 | Germany . |
| 1267305 | 3/1972 | United Kingdom . |
| 2257474 | 1/1993 | United Kingdom . |

*Primary Examiner*—Joseph A. Kaufman
*Attorney, Agent, or Firm*—Zarley, McKee, Thomte, Voorhees & Sease

[57] ABSTRACT

Valve (10) for the discharge of fluids which are under pressure, especially liquids, pastes, creams or gels or the like, with a discharge tube which can be moved in a valve body out of a closed position against the action of a resilient member, especially a helical compression spring, to which tube a pot-like closing member (12), working together with a ring seal made of rubber or the like and closely surrounding the discharge tube (11), is allocated. The discharge tube (11) has, on its opposite end from the discharge aperture (13), a surrounding ring projection (14) with axial indentations (15) which can be snapped into a corresponding ring undercut (16) of the pot-like closing member (12).

24 Claims, 3 Drawing Sheets

VALVE FOR THE DISCHARGE OF FLUIDS WHICH ARE UNDER PRESSURE

BACKGROUND OF THE INVENTION

The invention relates to a valve for the discharge of fluids which are under pressure, especially liquids, pastes, creams or gels or the like.

A valve of this type is described in AT 388 715 B. The valve in question is one which is widely used commercially. A valve of this type is to be described in greater detail with reference to FIG. 5. This valve, which is provided with the reference number 30, has a valve body 33 which can be fastened fluid-tight to the edge 31 of a lid aperture formed in a container lid 32, a discharge tube 35 which can be moved axially in the valve body out of a closed position corresponding to FIG. 5 against the action of a resilient member, namely here a helical compression spring 34, and a ring seal 36 made of rubber or similar resilient sealing material and arranged between the edge 31 of the lid aperture and the valve body 33, closely surrounding the discharge tube 35. A closing member 38, acting together with the ring seal 36, is allocated to a fluid entry point formed on the end of the discharge tube 35 inside the valve body. This closing member 38 is a pot-like member, effective inside the valve body 33 and with a ring flange 39 with a ring projection 40 turned towards the ring seal 36. Into this pot-like closing member 38 extends the inner section, or the section located in the valve body 33, of the discharge tube 35. The fixing of the discharge tube 35 inside the pot-like closing member 38 is done as a press fit, i.e. friction-tight. If the discharge tube 35 is pressed into the inside of the container, i.e. into the lid aperture, a corresponding pulling of the pot-like closing member 38 occurs against the action of the helical compression spring 34. Thus the ring projection 40 of the pot-like closing member 38 is raised from the ring seal 36, which results in the formation of a fluid connection between the fluid entry point 37 of the discharge tube 35 and the inside of the valve body 33. The inside of the valve body 33 has a fluid connection with the inside of the container via a fluid channel 41 opening into the inside of the container, a flexible tube 42, preferably extending as far as the base of the container, not shown in greater detail, being attached to the fluid channel 41.

A surrounding fluid seal 43 is allocated to the outer edge of the lid 32, which seal, in its mounted state, is squeezed between the edge of the lid and the edge of the container aperture. The state of this seal before being mounted is shown in FIG. 5 on the left-hand side, and on the right hand side after being mounted.

As can also be recognised from FIG. 5, the inside of the valve body, or in FIG. 5 the lower peripheral edge of the discharge tube 35, is formed by four claws 44, evenly distributed over the perimeter and placed inside a ring-shaped base groove of the pot-like closing member 38, as a press fit as already mentioned above. The free spaces between the claws 44 mentioned define the fluid entry point 37 of the discharge tube 35 inside the valve body. The strength of the claws 44 for fixing the discharge tube 35 inside the pot-like closing member 38 is sufficient for the axial discharge of the discharge tube 35. However if an opening of the discharge tube 35 through sideways tilting of the same is considered, with the known construction there would be the danger of the discharge tube breaking in the area of the claws 44 or in the area of the connection of same to the discharge tube. The same can of course happen if, in the construction according to FIG. 5, the discharge tube 35 is tilted by mistake.

Proceeding from known prior art, the purpose underlying the present invention is to make available a discharge valve which is characterised by a connection between discharge tube and pot-like closing element which is simpler to manufacture and assemble and with which, moreover, the discharge valve is particularly resistant to tilting.

SUMMARY OF THE INVENTION

Through the snap-in or snap connection, according to the invention, between discharge tube and pot-like closing member, it is no longer necessary to manufacture such perfectly fitting parts as are necessary for the known frictional connection between discharge tube and closing member. Also, the manufacture of the snap-in or snap connection according to the invention does not have any special requirements in assembly. Moreover, the strength of the connection according to the invention is greater than that according to FIG. 5, since it is effected along an almost completely closed, surrounding ring projection on the opposite end of the discharge tube from the discharge aperture. Only narrow axial indentations are needed in order to guarantee the necessary fluid connection between discharge tube and the inside of the associated valve body.

Because of the fact that the pot-like closing member has a centrally projecting pin, over which practically the whole length of the discharge tube can be pushed, an increased resistance to bending stress, such as arises when the discharge tube is tilted, is achieved. Whilst with the known valve according to FIG. 5, when the discharge tube 35 is tilted, the corresponding tilting moment is transmitted to the pot-like closing member via only a relatively short peg; according to the invention this transmission of the moment of force and the moment of torsion takes place via the whole length of the centrally projecting pin, and thus via the whole length of the discharge tube directly to the pot-like closing member. The centrally projecting pin causes the tilting moment exerted on the discharge tube to be transmitted almost directly to the pot-like closing member.

A preferred embodiment of a valve formed according to the invention is described in greater detail below, with the aid of the drawings.

DETAILED DESCRIPTION OF THE PREFERRED EMBODIMENT

Figure 1:
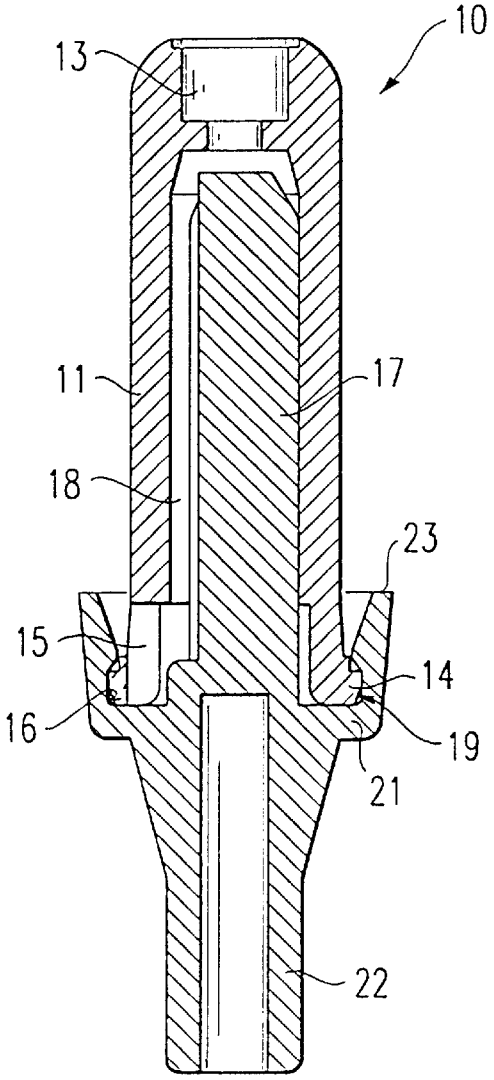
FIG. 1 a valve formed according to the invention, in diagrammatic longitudinal section.
Figure 2:
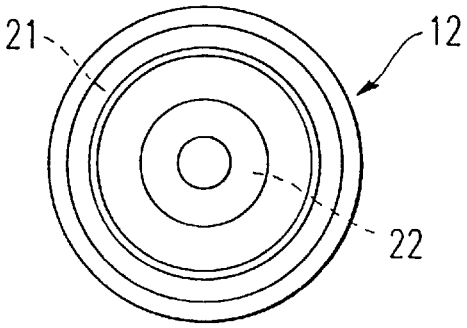
FIG. 2 the valve according to FIG. 1 in plan view.
Figure 4B:
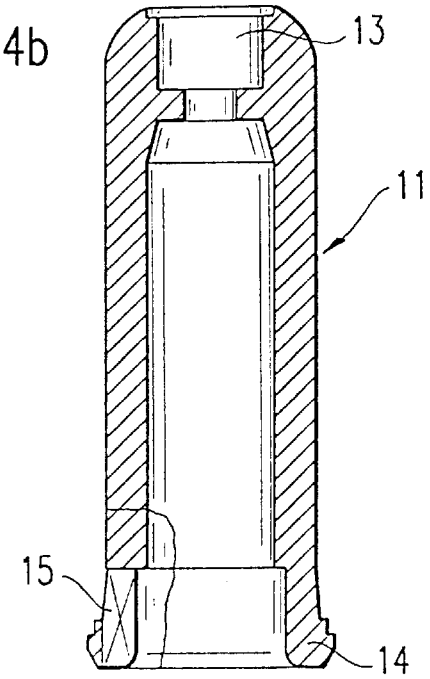
FIG. 4*b* the discharge tube allocated to the closing member according to FIG. 4*a,* in longitudinal section.
Figure 4A:
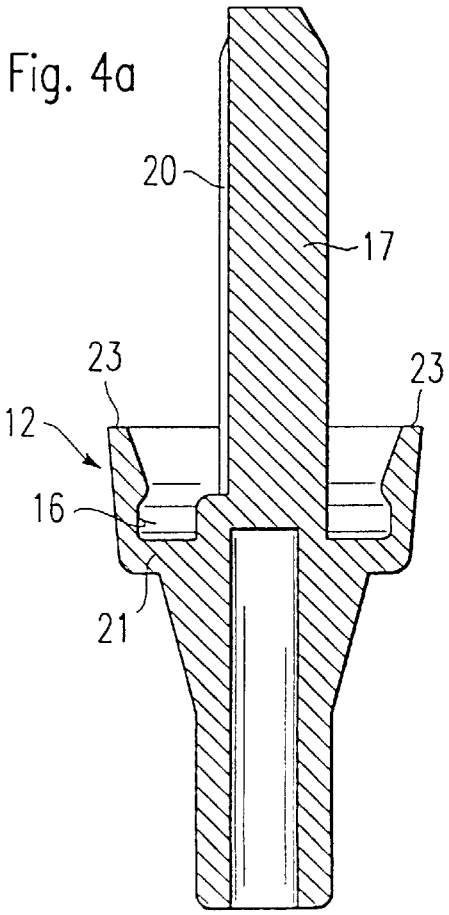
FIG. 4*a* the closing element of the valve according to FIG. 1, in longitudinal section.
Figure 5:
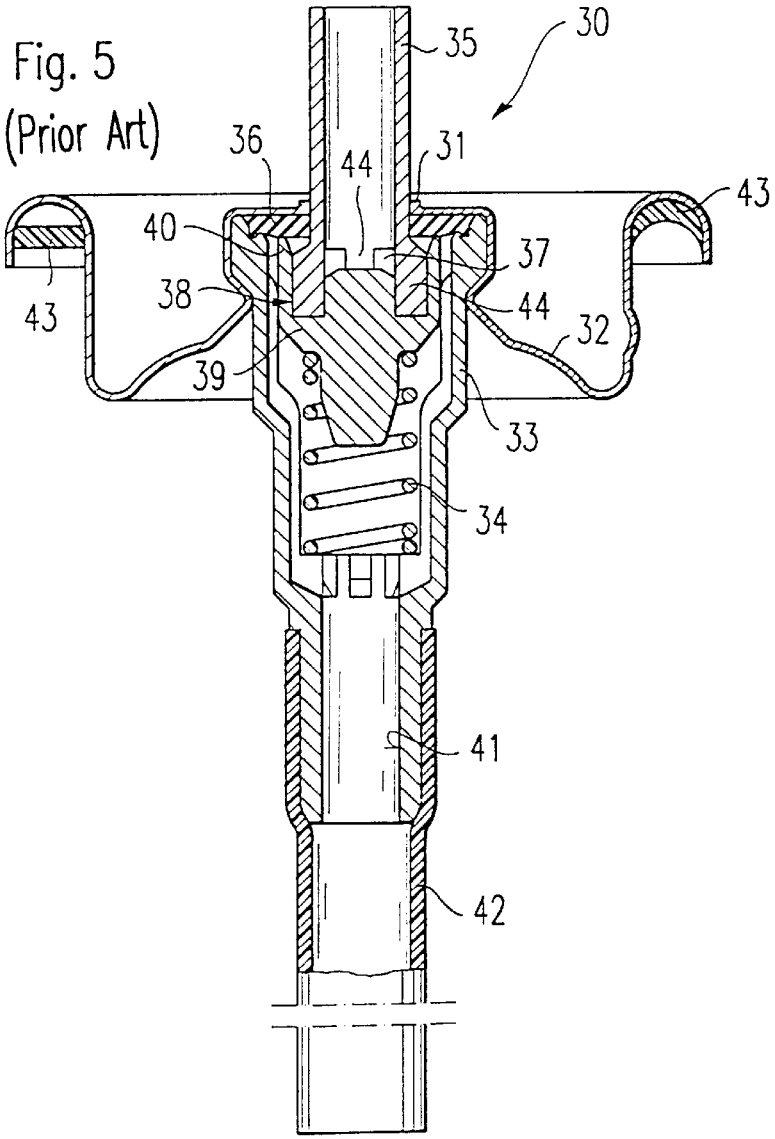
Fig. 5 (Prior Art)
FIG. 5 a discharge valve according to prior art, mounted on the lid of a fluid container and in longitudinal section.

The valve 10, shown in diagrammatic longitudinal section in FIG. 1, for the discharge of fluids which are under pressure, has a discharge tube 11, which can be moved in a valve body (not shown) out of a closed position against the action of a resilient member, especially a helical compression spring, and to which is allocated a pot-like closing member 12 working together with a ring seal corresponding to ring seal 36 according to FIG. 5, made of rubber or the like and closely surrounding the discharge tube. The discharge tube 11 defines a discharge aperture 13 at the end of the tube which is accessible from outside after assembly. At the end opposite to this discharge aperture 13, the discharge tube 11 has a surrounding ring projection 14 with axial indentations 15. This ring projection 14, which is formed almost completly closed with the exception of the axial indentations mentioned, is capable of being snapped into a complementary ring undercut 16 of the pot-like closing member 12. According to FIG. 1, this ring undercut is formed in the inside of the pot-like closing member 12.

In addition, the pot-like closing member 12 has a centrally projecting pin 17, over which practically the whole length of the discharge tube 11 can be pushed, in such a way that, between discharge tube 11 and pin 17 a continuous fluid channel 18 is defined between the discharge aperture 13 of the discharge tube 11 and its anchorage 19 with the pot-like closing member 12. The anchorage 19 is formed by the mentioned snap-in connection between ring projection 14 and complementary ring undercut 16.

Figure 3B:
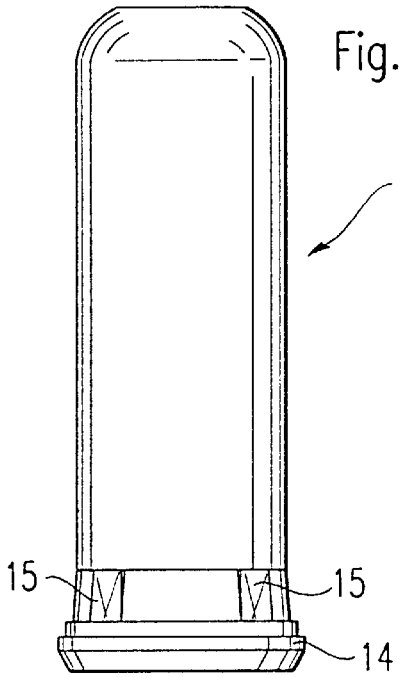
FIG. 3*b* the discharge tube, allocated to the closing member, of the valve according to FIG. 1, in side view.
Figure 3A:
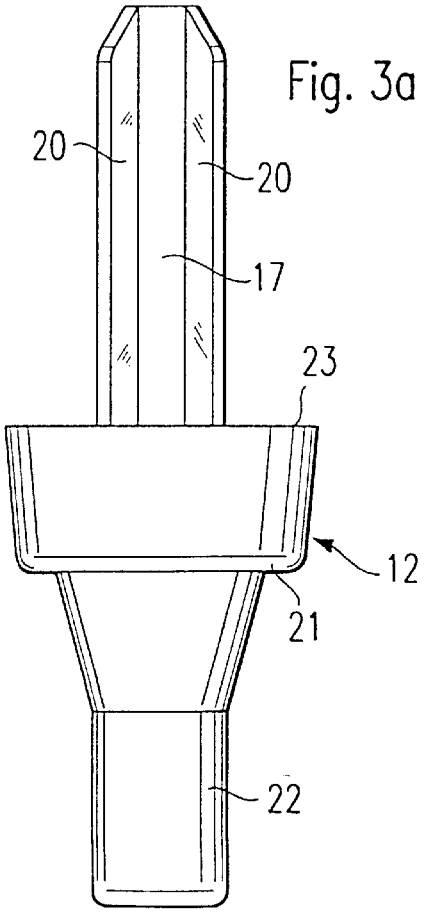
FIG. 3*a* the closing member of the valve according to FIG. 1, in side view.
Figure 3C:
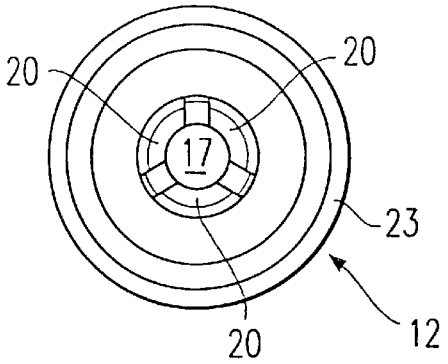
FIG. 3*c* the closing member according to FIG. 3*a* in plan view.

The centrally projecting pin 17 has at least one longitudinal groove 20, here three such grooves (see FIG. 3*c*), arranged evenly distributed over the perimeter to form the mentioned fluid channel 18 between pin 17 and discharge tube 11. Besides, the discharge tube 11 can be pushed, free from play, over the centrally projecting pin 17, so that the discharge tube forms with the allocated pot-like closing member a constructional unit, which can be moved, especially tilted out of the closed position. In this way, the direct load transmission, mentioned initially, when the discharge tube is tilted to the pot-like closing member 12 is guaranteed.

To the outside of the base 21 of the pot-like closing member 12, is joined an elongate, namely sleeve-like extension 22, over which, in its mounted state, the helical compression spring mentioned with the aid of FIG. 5 extends, which spring is supported on the base of the pot-like closing member 12 on the one hand, and on a valve body secured to a lid of a fluid container on the other hand, and presses the pot-like closing member 12 with its peripheral edge 23 against the ring seal closely surrounding the discharge tube 11.

The centrally projecting pin has in the present case an approximately star-shaped cross-section. Alternatively this cross-section can be triangular, square or cross-shaped. The outer edges of the longitudinal webs formed between the longitudinal grooves 20 define an outer diameter which corresponds approximately to the inner diameter of the discharge tube 11.

The peripheral edge 23 of the pot-like closing member 12 is enlarged conically outwards, more on the inside than on the outside. The ring-shaped undercut 16 is formed on the inside near the base 21 of the closing member 12.

The pot-like closing member 12 is formed integrally with the centrally projecting pin 17 and the outer sleeve-like extension 22. The extension 22 could in principle also be manufactured from solid material. The central bore, and thus the formation of the extension 22 as a sleeve, serves however to save material. In addition to this, unnecessary material accumulations and the material stress arising therefrom can be avoided.

All the features disclosed in the application documents are claimed as essential features of the invention, insofar as they are, individually or in combination, new in relation to prior art.

What is claimed is:

1. A valve for discharging fluids which are under pressure, comprising:

a valve body;

a discharge tube movably mounted on the valve body having a closed position connected to the valve body, the discharge tube being movable from the closed position against the action of a resilient member;

the discharge tube having opposite ends, a discharge aperture extending through one end and a surrounding ring projection with axial indentations therein being formed at the other end of the tube;

a pot-shaped closing member having a peripheral edge for surrounding the discharge tube above the ring projection, the closing member further having an annular ring undercut therein for snappingly receiving the ring projection of the discharge tube; and sealing means operatively interposed between the peripheral edge of the closing member and the discharge tube;

the closing member having a centrally projecting pin over which the discharge tube can be pushed in such a way that a continuous fluid channel is defined between discharge tube and the pin and extends between the discharge aperture of the discharge tube and the other end of the tube.

2. A valve according to claim 1, wherein the centrally projecting pin has at least one longitudinal groove therein defining the fluid channel between the pin and the discharge tube.

3. A valve according to claim 2, wherein the discharge tube can be pushed, free from play, over the centrally projecting pin, so that the discharge tube forms with the associated closing member a constructional unit which can be moved out of the closed position.

4. A valve according to claim 2, wherein the closing member has a base and an outside surface of the base of the closing member is joined to an elongated sleeve extension, over which, in a mounted state, a helical compression spring extends which is supported on the base of the closing member and on the valve body secured to a lid of a fluid container and presses the peripheral edge of the closing member against the sealing means.

5. A valve according to claim 2 wherein the centrally projecting pin of the closing member has a cross-shaped cross-section, which defines an external diameter which corresponds approximately to the interior diameter of the discharge tube.

6. A valve according to claim 2 wherein the peripheral edge of the closing member is enlarged conically outwards at least on the inside and surrounds a ring undercut near the base of the closing member.

7. A valve according to claim 2, wherein the closing member is formed integrally with the centrally projecting pin and the elongated sleeve extension.

8. A valve according to claim 1, wherein the discharge tube can be pushed, free from play, over the centrally projecting pin, so that the discharge tube forms with the associated closing member a constructional unit which can be tilted out of the closed position.

9. A valve according to claim 8, wherein the closing member has a base and an outside of the base of the closing member is joined to an elongated sleeve extension, over which, in a mounted state, a helical compression spring extends which is supported on the base of the closing member and on the valve body secured to a lid of a fluid container and presses the peripheral edge of the closing member against the sealing means.

10. A valve according to claim 8 wherein the centrally projecting pin of the closing member has a cross-shaped cross-section, which defines an external diameter which corresponds approximately to the interior diameter of the discharge tube.

11. A valve according to claim 8 wherein the peripheral edge of the closing member is enlarged conically outwards at least on the inside and surrounds a ring undercut near the base of the closing member.

12. A valve according to claim 8, wherein the closing member is formed integrally with the centrally projecting pin and the elongated sleeve extension.

13. A valve according to claim 1 wherein the closing member has a base and an outside surface of the base of the closing member is joined to an elongated sleeve extension, over which, in a mounted state, a helical compression spring extends which is supported on the base of the closing member and on the valve body secured to a lid of a fluid container, and presses the peripheral edge of the closing member against the sealing means.

14. A valve according to claim 13, wherein the closing member is formed integrally with the centrally projecting pin and the elongated sleeve extension.

15. A valve according to claim 13 wherein the centrally projecting pin of the closing member has a cross-shaped cross-section, which defines an external diameter which corresponds approximately to the interior diameter of the discharge tube.

16. A valve according to claim 13 wherein the peripheral edge of the closing member is enlarged conically outwards at least on the inside and surrounds a ring undercut near the base of the closing member.

17. A valve according to claim 13, wherein the closing member is formed integrally with the centrally projecting pin and the elongated sleeve extension.

18. A valve according to claim 1 wherein the centrally projecting pin of the closing member has a cross-shaped cross-section, which defines an external diameter which corresponds approximately to the interior diameter of the discharge tube.

19. A valve according to claim 18 wherein the peripheral edge of the closing member is enlarged conically outwards at least on the inside and surrounds a ring undercut near the base of the closing member.

20. A valve according to claim 18, wherein the closing member is formed integrally with the centrally projecting pin and the elongated sleeve extension.

21. A valve according to claim 1 wherein the peripheral edge of the closing member is enlarged conically outwards at least on the inside and surrounds a ring undercut near the base of the closing member.

22. A valve according to claim 21, wherein the closing member is formed integrally with the centrally projecting pin and the elongated sleeve extension.

23. A valve according to claim 1 wherein the peripheral edge of the closing member is enlarged conically outwards at least on the inside and surrounds a ring undercut near the base of the closing member.

24. A valve according to claim 1, wherein the closing member is formed integrally with the centrally projecting pin and the elongated sleeve extension.

* * * * *